United States Patent [19]

Marc

[11] 4,153,254

[45] May 8, 1979

[54] PUZZLE

[75] Inventor: Michel Marc, Wellesley, Mass.

[73] Assignee: Clint, Inc., Natick, Mass.

[21] Appl. No.: 826,356

[22] Filed: Aug. 22, 1977

[51] Int. Cl.[2] ..... A63F 9/12

[52] U.S. Cl. ..... 273/160; 35/72

[58] Field of Search ..... 273/160; 35/72

[56] References Cited

U.S. PATENT DOCUMENTS

| | | | |
|---|---|---|---|
| 3,065,970 | 11/1962 | Besley | 273/160 |
| 3,672,681 | 6/1972 | Wolf | 46/26 X |

FOREIGN PATENT DOCUMENTS

| | | | |
|---|---|---|---|
| 1154 | 4/1906 | United Kingdom | 273/160 |

OTHER PUBLICATIONS

"Polyominoes" by Solomon W. Golomb; publ. by Charles Scribner's Sons.; New York, copyright 1965; pp. 116–118, 126.

Scientific American; Sep. 1972; pp. 176, 177, 178, 180, 182.

*Primary Examiner*—Anton O. Oechsle

*Attorney, Agent, or Firm*—Wolf, Greenfield & Sacks

[57] ABSTRACT

A three dimensional puzzle game, having a plurality of components which, when assembled, form a polyhedron of a specific volume. Polyhedrons of different volumes are formed by assembly of a specific quantity and type of puzzle components. There is only one solution of the puzzle for each quantity of puzzle components used to form a particular polyhedron.

7 Claims, 3 Drawing Figures

PUZZLE

BACKGROUND OF THE INVENTION

In today's inflationary society, recreational diversions from one's work or school obligations are becoming increasingly expensive. Many families and individuals are seeking less expensive means of entertainment that can be enjoyed both in and out of the home. For these reasons, puzzles and games which provide stimulating competition to a player are enjoying greater popularity.

Although three dimensional puzzles have existed for some time, they are often limited by their lack of versatility or competitive complexity. A number of three dimensional puzzles are available in which the pieces may be assembled in numerous ways to form a single desired polyhedron. Typical of these puzzles are those commonly marketed under the trademarks "Instant Insanity" and "Soma". These puzzles are relatively easy to put together in that there is a number of possible solutions, each requiring the use of all the component pieces.

BRIEF DESCRIPTION OF THE INVENTION

The present invention is a three dimensional puzzle having a plurality of components which when assembled form a polyhedron of a specific volume. Polyhedrons of differing volumes may be formed by assembling a quantity of puzzle components less than the total quantity. Thus, the present invention provides a player a plurality of puzzle problems, each having a unique solution.

In a preferred embodiment of the present invention a puzzle having ten pieces is provided, each piece being comprised of a plurality of attached cubic units. The ten pieces when placed together in a specific arrangement are shaped in the form of a cube having length, width and height equal to four cubic units in dimension. Each individual piece of the puzzle represents a distinct cubic configuration which, when all ten are used, can be placed together in only one distinct arrangement.

Added versatility is achieved by the present invention in that seven of the ten pieces can be arranged to form a polyhedron represented dimensionally by $4\times4\times3$ cubic units. The use of six of the ten pieces when correctly arranged form a polyhedron having a $3\times3\times4$ cubic unit dimension.

In order to maintain the competitive complexity of the puzzle, indiscriminate combinations of pieces for the $4\times4\times3$ and $3\times3\times4$ dimensional units will not provide a player the solution to the puzzle. In order to solve the puzzle, seven or six, as the case may be, specific unalterable pieces must be correctly arranged to arrive at the proper configured polyhedron. Thus, the level of skill required to solve the $4\times4\times3$ and $3\times3\times4$ configured puzzle is distinctly different from that of the $4\times4\times4$ configuration in that the player must have the additional skill of eliminating those particular pieces not needed for the smaller size puzzle.

Although the preferred embodiment described herein has three specific polyhedron solutions, each having a distinct volume, it can be appreciated that the quantity of solutions can be increased or decreased by altering the shape of pieces accordingly. Each solution would be achieved using a specific quantity and selection of pieces.

DETAILED DESCRIPTION OF THE INVENTION

Figure 1:
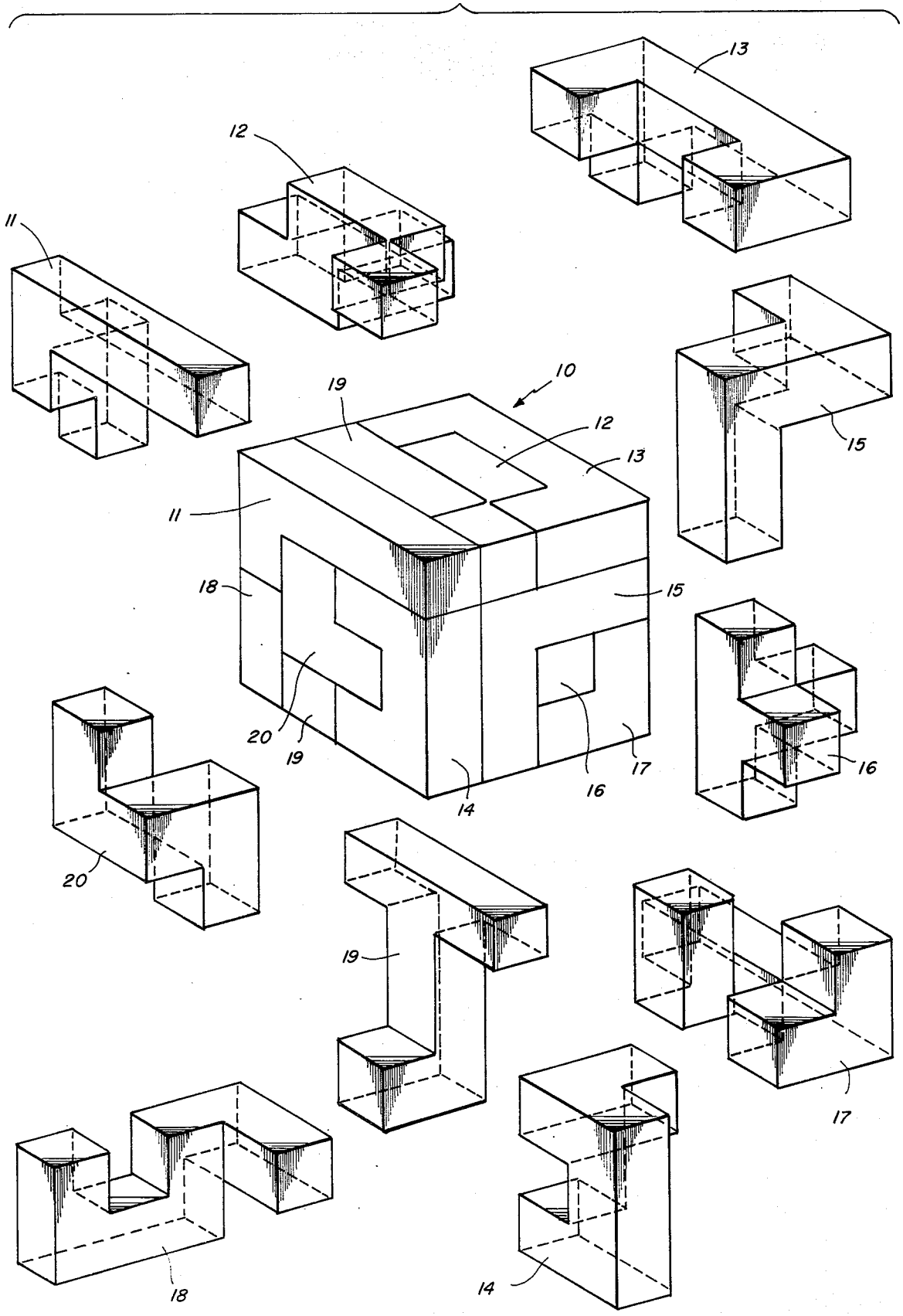
FIG. 1 is a perspective view of the $4\times4\times4$ cubic unit size puzzle along with an exploded view of each of its ten components.

In FIG. 1 is shown a perspective and exploded view of a preferred embodiment of the present invention. Shown are component pieces 11 through 20 inclusive which, when properly arranged, form a cube 10. The component pieces 11–20 may be made of any suitable material such as wood, plastic or metal. Each component has its edges finished in such a manner as to enable the components to fit easily together. Such finishing techniques are known to those skilled in the art.

To solve the puzzle, each component must be distinctly arranged in relation to the other components, as shown in FIG. 1, so that when all ten component pieces are used, a $4\times4\times4$ cubic unit cube, 10, is formed. An error in arrangement of just one component will prevent a player from successfully completing the puzzle.

Figure 2:
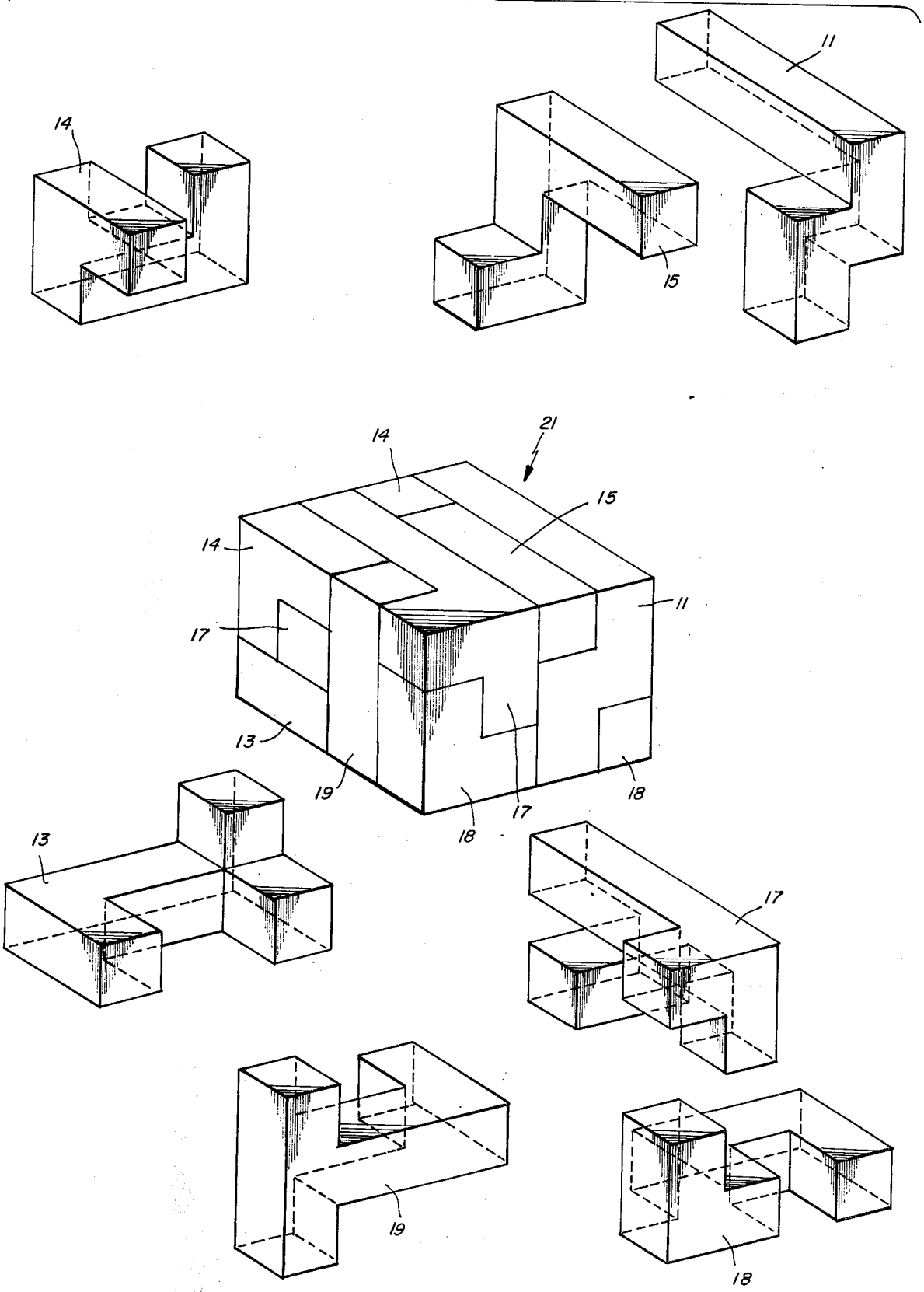
FIG. 2 is a perspective view of the $4\times4\times3$ cubic unit size puzzle along with an exploded view of each of its seven components.

Shown in FIG. 2 is a perspective and exploded view of the $4\times4\times3$ cubic unit puzzle. To solve this puzzle problem, a player must select seven specific components from the total of ten used in FIG. 1, and, as stated above, arrange each component in such a way as to form a specific polyhedron. The seven specific components 11, 13, 14, 15, 17, 18 and 19, are shown in FIG. 2 to form polyhedron 21 having a volume smaller than cube 10 in FIG. 1.

Figure 3:
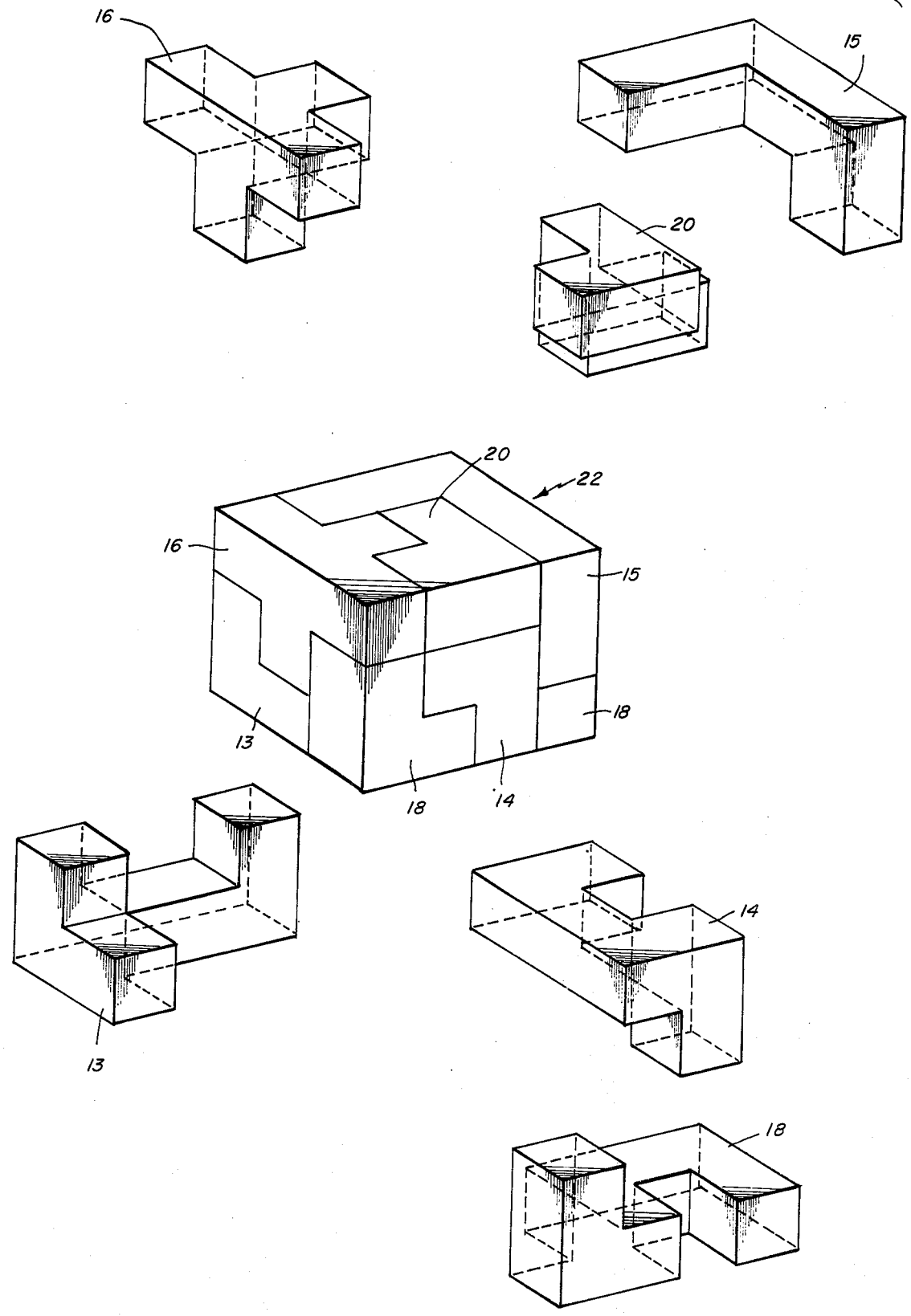
FIG. 3 is a perspective view of the $3\times3\times4$ cubic unit size puzzle along with an exploded view of each of its six components.

In FIG. 3 is shown a perspective and exploded view of the $3\times3\times4$ cubic unit puzzle, wherein only six components 13, 14, 15, 16, 18 and 20 are shown to form polyhedron 22. Thus, this particular size puzzle, as well as the one shown in FIG. 2, requires the additional skill on the part of a player to choose a specific number of components which is less than the number of pieces needed to solve the puzzle shown in FIG. 1.

As can be appreciated, each component 11 through 20 inclusive may be of varying colors for cosmetic reasons. Also, the overall volume of the formed polyhedrons 10, 21 and 22 may be varied depending upon the size desired. For example, a businessman may want a smaller than average size unit so as not to be cumbersome when traveling, whereas a child may desire a larger unit for purposes of being easier to handle each individual component.

I claim:

1. A three dimensional puzzle game comprising:

a plurality of component pieces, each of said component pieces being unique from each other and being configured to form a polyhedron having a quantity of horizontal surfaces and a quantity of vertical surfaces each greater than two so that assembly of a first quantity, a second quantity and a third quantity of said component pieces each forming a solid having six surfaces, said first, second and third quantities of said component pieces each having only one combination of said component pieces to form said six surface solid.

2. A three-dimensional puzzle game in accordance with claim 1 wherein said first quantity of said component pieces being a maximum quantity of said component pieces of said puzzle game, which when assembled form a cube.

3. A three-dimensional puzzle game in accordance with claim 2 wherein said first quantity of component pieces comprises ten component pieces.

4. A three-dimensional puzzle game in accordance with claim 1 wherein said second quantity of said component pieces is smaller than the first quantity of said component pieces so that upon assembly they form a solid having two square surfaces and four rectangular surfaces, each of said square surfaces having a greater surface area than each of said rectangular surfaces.

5. A three-dimensional puzzle game in accordance with claim 4 wherein said second quantity of said component pieces comprises seven component pieces.

6. A three dimensional puzzle game in accordance with claim 1 wherein said third quantity of said component pieces is smaller than the second quantity of said component pieces, so that upon assembly they form a solid having two square surfaces and four rectangular surfaces, each of said rectangular surfaces having a greater surface area than each of said square surfaces.

7. A three-dimensional puzzle game in accordance with claim 6 wherein said third quantity of said component pieces comprises six component pieces.

* * * * *